United States Patent [19]

Hughes

[11] Patent Number: 4,730,423

[45] Date of Patent: Mar. 15, 1988

[54] APPARATUS AND METHOD FOR PROTECTING COOLING UNITS

[75] Inventor: Gary W. Hughes, Little Rock, Ark.

[73] Assignee: Pulaski Industries, Little Rock, Ark.

[21] Appl. No.: 77,730

[22] Filed: Jul. 27, 1987

Related U.S. Application Data

[63] Continuation-in-part of Ser. No. 837,123, Mar. 7, 1986, abandoned.

[51] Int. Cl.[4] ..... F04B 1/34; F04B 7/02; A45F 1/14

[52] U.S. Cl. ..... 52/173 R; 52/27; 52/74; 52/93; 52/741; 62/259.1; 135/87; 160/127

[58] Field of Search ..... 52/74, 93, 173 R, 27, 52/40, 741, 3; 47/31, 26; 135/96, 87; 62/259.1, 331

[56] References Cited

U.S. PATENT DOCUMENTS

| | | | |
|---|---|---|---|
| 2,023,155 | 12/1935 | Turner | 135/87 |
| 2,293,329 | 8/1942 | Coburn | 160/128 X |
| 2,876,715 | 3/1959 | Banks | 52/3 |
| 2,892,424 | 6/1959 | Mondi | 52/3 |
| 2,902,730 | 9/1959 | Meagher | 52/74 |
| 2,914,075 | 11/1959 | Wells et al. | 62/331 |
| 2,928,405 | 3/1960 | Lawson | 135/87 X |
| 2,980,124 | 4/1961 | Atchison | 135/901 X |
| 3,174,195 | 3/1965 | Francis | 52/74 X |
| 3,381,424 | 5/1968 | Butler | 52/173 X |
| 3,581,436 | 6/1971 | Basiger | 135/87 X |
| 4,053,008 | 10/1977 | Baslow | 52/273 X |
| 4,068,673 | 1/1978 | Bernardi | 160/22 |
| 4,099,344 | 7/1978 | Ruemeli | 135/87 |
| 4,192,112 | 3/1980 | Reilly, Sr. | 52/222 |
| 4,470,718 | 9/1984 | Cwik | 52/656 X |
| 4,498,262 | 2/1985 | Garcia | 52/3 X |
| 4,649,675 | 3/1987 | Moldovan et al. | 52/40 X |

FOREIGN PATENT DOCUMENTS

| | | | |
|---|---|---|---|
| 569116 | 1/1959 | Canada | 135/901 |
| 7705955 | 12/1978 | Netherlands | 47/26 |
| 138795 | 5/1930 | Switzerland | 47/31 |
| 313703 | 6/1929 | United Kingdom | 47/31 |

*Primary Examiner*—Alfred C. Perham
*Attorney, Agent, or Firm*—Griffin, Branigan & Butler

[57] ABSTRACT

A sun protection assembly (10) for shielding an air conditioner/heat pump from the direct rays of the sun. The assembly comprises a frame (12) to which a screen (14) is attached. Front and rear legs (16) are attached to the frame to support the assembly a predetermined distance above the ground.

28 Claims, 11 Drawing Figures

APPARATUS AND METHOD FOR PROTECTING COOLING UNITS

I. Field of the Invention

This is a continuation-in-part of application Ser. No. 06/837,123, filed Mar. 7, 1986 now abandoned.

BACKGROUND OF THE INVENTION

This invention relates to apparatus and method for increasing the efficiency of air conditioning/heat pump units of the type in which a cooling section is located outside a building, and in particular relates to a sun protection assembly for protecting the cooling unit from the sun.

II. Prior Art and Other Considerations

It is known that cooling units, such as external air conditioning/heat pumps, operate more efficiently in their cooling mode if the unit is in the shade rather than in direct exposure to the sun. On hot days, cooling units operate less efficiently due to the heat build-up on the cooling unit housing. The surface temperature of the cooling unit and the surrounding air temperature rise to a point where there is insufficient heat dissipation from the freon coils of the air conditioner/heat pump unit. Thus, the unit must operate for longer periods of time to remove heat from the freon coils. The prolonged operation of the unit wastes energy.

In view of the above, it is an object of the present invention to provide a sun protection assembly which is positionable above an outside cooling unit to prevent the sun's heat rays from unnecessarily heating the cooling unit.

An advantage of the present invention is the provision of a self-leveling assembly.

Another advantage is the ease of assembly from a assembling the present invention from a kit.

SUMMARY

A sun protection assembly for shielding an air conditioner/heat pump unit from the direct rays of the sun. The assembly comprises a frame to which a screen is attached. Front and rear legs are attached to the frame to support the assembly a predetermined distance above the ground.

DETAILED DESCRIPTION OF THE DRAWINGS

Figure 1:
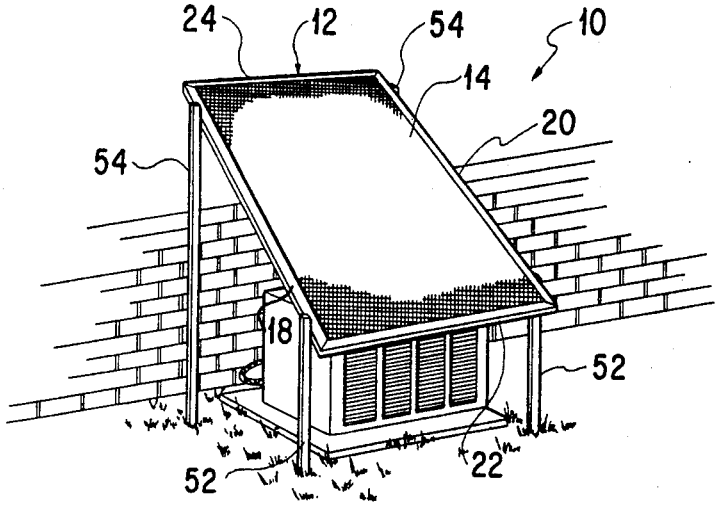
FIG. 1 is a perspective view of a sun protection assembly mounted according to a first embodiment of the invention.
Figure 2:
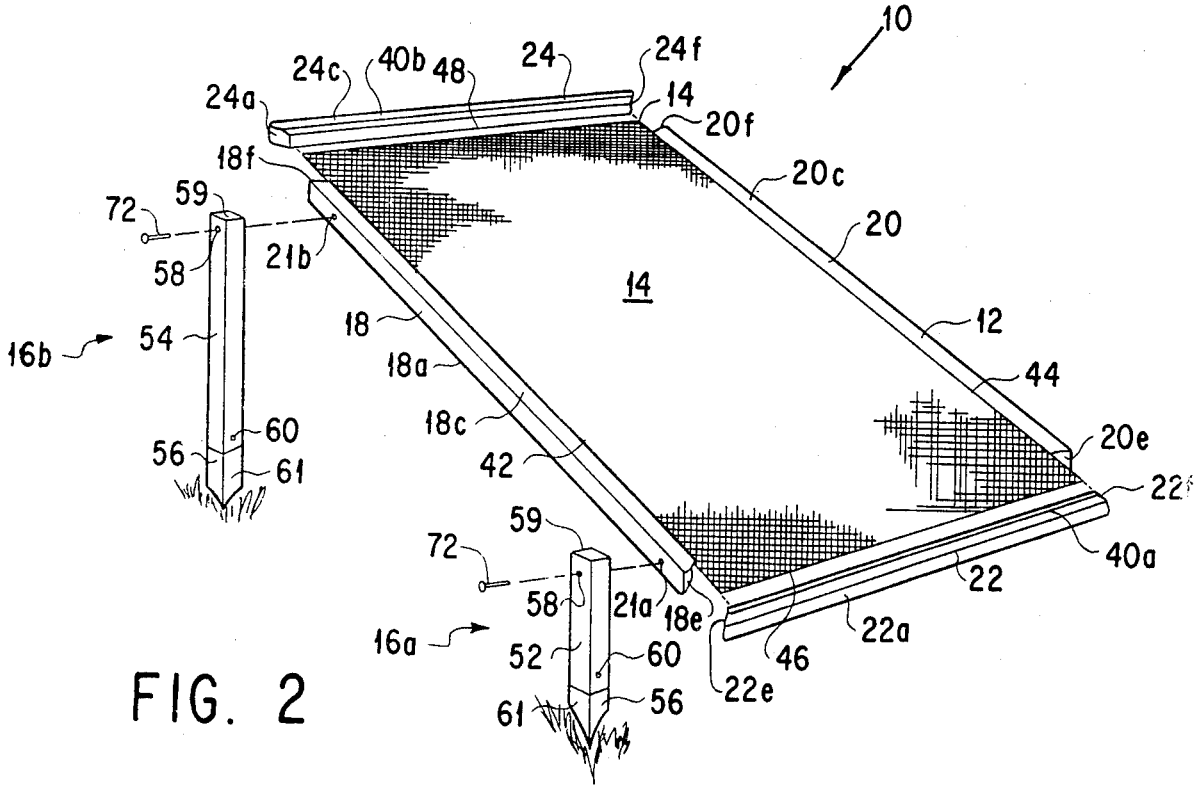
FIG. 2 is an exploded perspective view of the sun protection assembly of the embodiment of FIG. 1.
Figure 3:
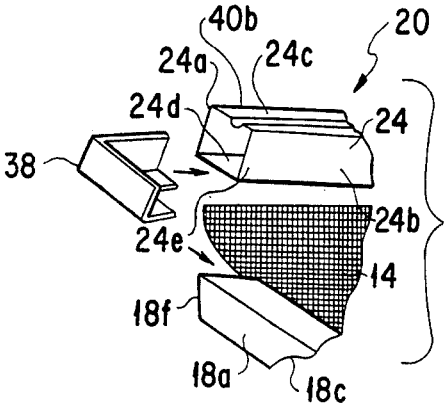
FIG. 3 is an exploded perspective view of a portion of a frame of the sun protection assembly of the embodiment of FIG. 1.
Figure 4:
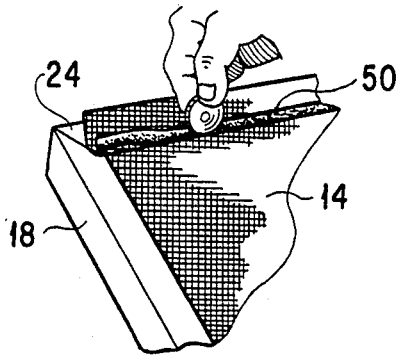
FIG. 4 is a partial perspective view showing a step in the installation of a cover to the frame of the embodiment of FIG. 1.
Figure 5:
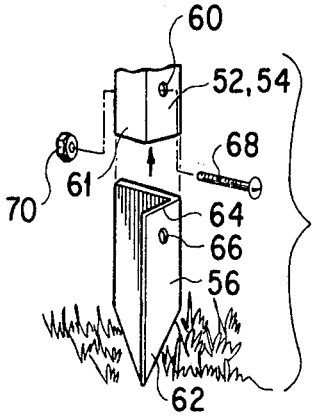
FIG. 5 is a perspective view showing a step in the assembly of anchoring means used in the embodiment of FIG. 1.
Figure 6:
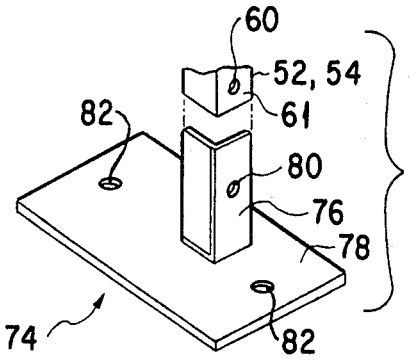
FIG. 6 is a perspective view showing a step in the assembly of the anchoring means used in a second embodiment of the invention.

A sun protection assembly 10 of the embodiment of FIG. 1 comprises a frame 12, a screen 14, and supporting means 16. Frame 12 and supporting means 16 are manufactured from any suitable material, such as aluminum or stainless steel. Screen 14 is preferably made of a flexible woven vinyl-coated fiberglass, such as that sold under the trademark Sunscreen. A flexible material not only dampens the sound of rain hitting the screen, but also permits folding of the screen for compact packaging.

The substantially rectangular frame 12 is manufactured from two side frame members 18, 20, and two end frame members 22, 24. While the exact dimensions of the frame members are not critical, they should be choosen so as to be larger than the cooling unit the assembly 10 is to protect. Side frame member 18 has two sides **18*a*, 18*b*, a top 18*c*, a bottom 18*d*, and two edges 18*e*, 18*f*. Side frame member 20 has two sides 20*a*, 20*b*, a top 20*c*, a bottom 20*d*, and two edges 20*e*, 20*f*. End frame member 22 has two sides 22*a*, 22*b*, a top 22*c*, a bottom 22*d*, and two edges 22*e*, 22*f*. Similarly, end frame member 24 has two sides 24*a*, 24*b*, a top 24*c*, a bottom 24*d*, and two edges 24*e*, 24*f*. A groove 40*a* extends from along the top 22*c* of end frame member 22 from one edge 22*e* to the second edge 22*f*. A similar groove 40*b* exists along the top 24*c* of end frame member 24. In a similar fashion, a groove (not shown) is placed in sides 18*b*, 20*b* of side frame members 18 and 20, extending from one edge of the side frame member to the other edge. A hole 21*a*, 21*b* is placed through sides 18*a*, 18*b* and 20*a*, 20*b* of each side frame member 18, 20 proximate each edge 18*e*, 18*f* and 20*e*, 20*f* to receive supporting means 16, to be described below. Edges 18*e*, 18*f*, 20*e*, 20*f*, 22*e*, 22*f* and 24*e*, 24*f* are miter cut at an approximate 45° angle so that a miter joint is formed by the assembly of an end frame member to a side frame member. Connecting means, such as corner bracket 38, is inserted into the ends of the frame members to assemble the frame 12**.

Screen 14 reflects the sun's ray but allows air to flow to the outside. The screen 14 has a left side edge 42, a right side edge 44, a front edge 46, and a rear edge 48. The length and width of the screen is chosen to be slightly larger than the inside dimensions of the frame 12. The left side edge 42 of the screen 14 is placed over the groove formed in the side frame member 18. The right side edge 44 of the screen 14 is placed over the groove formed in the side frame member 20. Securing means, such as a spline or rubber strip 50, is placed on top of the screen 14 and forced into the groove of the side frame members 18, 20 to retain the screen 14 in place.

Front edge 46 of the screen 14 is placed over the groove **40*a* in end frame member 22. As described above, a rubber strip 50 forced into the groove 40***a* secures the screen to the end frame member. The rear edge 48 of the screen 14 is pulled taut and secured to the groove 40*b* in end frame member 24 in a like manner.

Supporting means 16*a* comprises a pair of front legs 52, and a ground stake 56 associated with each leg. Supporting means 16*b* comprises a pair of rear legs 54 and a ground stake 56 associated with each leg. In the preferred embodiment, the legs 52, 54 are formed out of a hollow, substantially square tubing, such as aluminum, with the rear legs 54 being longer than the front legs 52. The length of the rear legs 54 to the front legs 52 are selected so that the assembly 10 will rest at an angle of approximately 45° to 75° relative to the ground. The optimum angle setting varies according to the geographic location and compass direction of the installation relative to the sun. A first hole 58 is placed through two parallel surfaces of the front and rear legs 52, 54 proximate a top end 59. A second hole 60 is placed through the remaining two sides of the legs 52, 54 perpendicular to the first hole 58, but proximate a bottom end 61.

Ground stake 56 is manufactured out of an angle iron material, such as galvanized steel. Each stake 56 has a pointed end 62 and a level end 64. A hole 66 is placed through a side of the angle iron proximate the level end 64, such that it will align with the hole 60 placed in the legs 52, 54. The ground stake 56 is inserted into the hollow opening in the bottom end 61 of the legs 52, 54 so that the holes 60 and 66 are aligned. First screw 68 is passed through the aligned holes and screwed into a nut 70 to create a permanent attachment.

Legs 52, 54 are attached to the frame 12 with an attaching means, such as a second screw 72 and nut (not shown). First hole 58 of the front legs 52 are aligned with the hole 21*a* in the side frame member 18, 20 which is proximate edge 34. Screw 72 is passed through the holes and engages the nut located against side 28 of the side frame members 18, 20. In a similar manner, the rear legs 54 are attached to the side frame members 18, 20 proximate edge 36.

In use, the sun protection assembly 10 is preferably obtained as a kit. A customer removes the components from a shipping box and assembles the device. The left and right side edges 42, 44 of the screen 14 are preferably but not necessarily preattached to the side frame members 18, 20. The customer inserts a corner bracket 38 into a side frame member. An end frame member is then attached to the corner bracket. This step is repeated three more times until rectangular frame 12 is assembled. After the frame is assembled, front and rear edges 46, 48 of the screen 14 are attached to the end frame members 22, 24 with the rubber strips 50. The stakes 56 are attached to the legs 52, 54 which are then attached to the side frame member 18, 20 with screws 72. However, at this point, the screws 72 are not tightened, so that the legs 52, 54 may swivel about the screw's axis. As shown in FIG. 1, the sun protection assembly 10 is positioned above a cooling unit. The stakes 56 are then forced into the ground. As the legs swivel about the axis of screw 72, the frame 12 will be self-leveling to the proper rest angle of approximately 45° to 75° relative to the ground. This rest angle prevents direct sunlight from reaching the cooling unit, but allows rain and snow to run-off. After the assembly 10 has leveled, the screws 72 are tightened so that the frame 12 can no longer move.

A second embodiment has been developed for locations in which the stake 56 can not be used, such as on a concrete floor or building rooftop. In this embodiment, foot pads 74 are substituted for the ground stakes 56. The foot pads 74 are preferably manufactured from galvanized steel and comprise an angle iron 76 and flat foot 78. The angle iron 76 is attached to the foot 78 at a perpendicular angle, using any suitable bonding means, such as welding. A hole 80 is placed through one side of the angle iron 76 to permit mounting of the foot pad 74 to the legs 52, 54 with a screw 68 and nut 70. A plurality of holes 82 are placed in the flat foot 78 to permit its attachment to a hard surface.

In use, the second embodiment is assembled as described for the first embodiment. However, instead of attaching the stakes to the legs, the foot pads 74 are attached to the legs 52, 54. After the sun protection assembly 10 is positioned in the proper location, appropriate mounting hardware is screwed through holes 82 in the foot pads 74 to secure the assembly 10 to the concrete floor or building rooftop.

Figure 7:
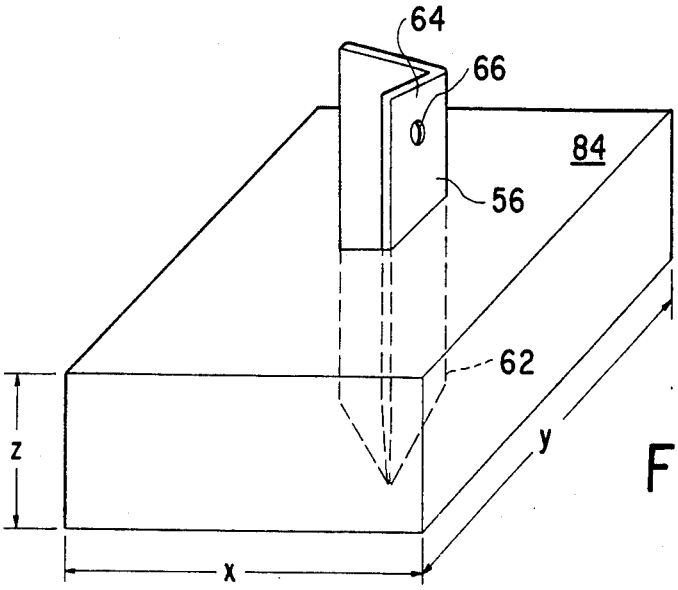
FIG. 7 is a perspective view showing a step in the assembly of the anchoring means used in a third embodiment of the invention.

A third embodiment has been developed for rooftop installations in which it is not desired to anchor foot pads to the roof. In this embodiment, shown in FIG. 7, the ground stakes 56 are embedded in a weighted means, such as concrete blocks 84. Each concrete block has a width x of approximately one foot, a length y of approximately one foot, and a height z of approximately five inches.

The third embodiment is primarily intended to be assembled by a professional installer. The installer pours concrete into a form (not shown) having the dimensions noted above. As the concrete hardens, the stakes 56 are pushed into the concrete. When the blocks 84 are hard, they are removed from the form (if desired). The blocks 84 are then positioned around the cooling unit at the desired locations and the assembly is put together as described in the first embodiment. The weight of the blocks 84 prevents the assembly 10 from tipping over or moving.

Figure 8:
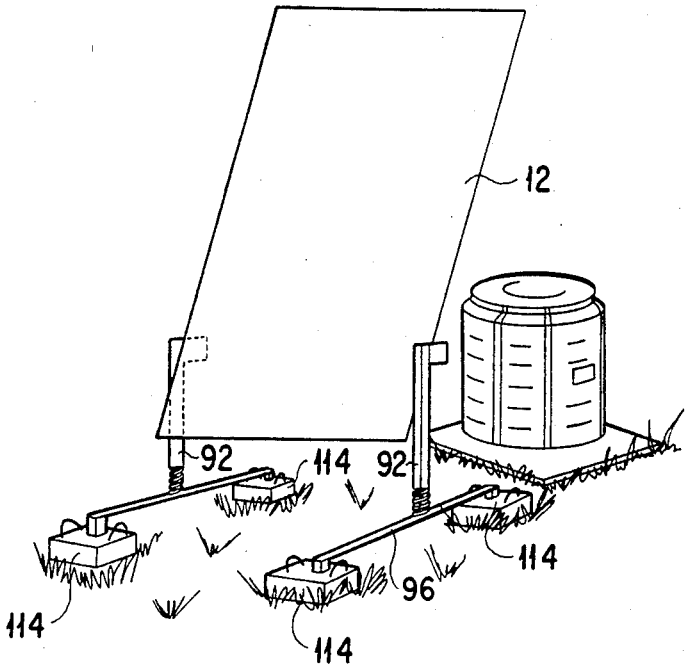
FIG. 8 is a perspective view of a sun protection assembly according to a fourth embodiment of the invention.
Figure 9:
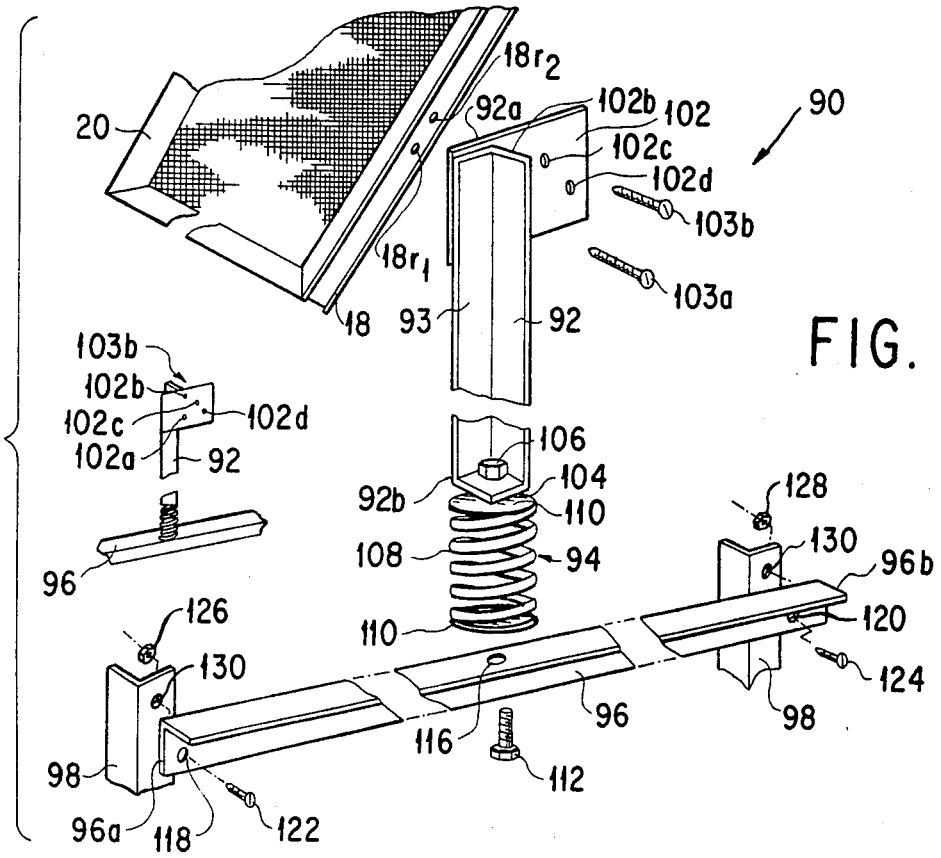
FIG. 9 is an exploded partial perspective view of the sun protection assembly of the embodiment of FIG. 8.

A fourth embodiment has been developed for use in locations subjected to high cross-winds. This embodiment, shown in FIG. 8, is typically used on building rooftops or paved surfaces. Sun protection assembly 88 is similar to the previous embodiments, except that two support means 90 are utilized in place of front and rear legs 52,54.

Figure 10:
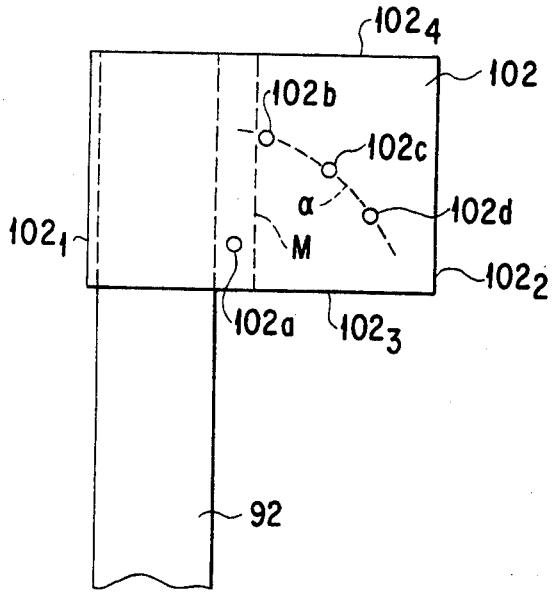
FIG. 10 is a view of an angle setting means used with the sun protection assembly of the fourth embodiment; and, FIG. 11 is a perspective view of the sun protection assembly of the fourth embodiment having a brake thereon.

Each support means 90 comprises a leg 92, a spring 94, a cross-member 96 and two post means 98. In the preferred embodiment, leg 92 is manufactured out of an angle iron material, such as galvanized steel or cast iron. An angle setting means 102 is attached to a side 93 proximate a first end 92*a* of leg 92 by any suitable means, such as by welding. The angle setting means 102 comprises a flat piece of metal having a width W and height H. Four apertures 102*a*, 102*b*, 102*c*, and 102*d* are drilled in the metal as shown in FIG. 10 so that the angle of frame 12 may be set to approximately 45°, 63° or 75° with respect to the ground. In the preferred embodiment, aperture 102*a* is made at a point proximate side $102_3$ and midpoint M. Apertures 102*b*, 102*c*, and 102*d* are created along an imaginary arc alpha. The arc alpha begins at a point proximate sides $102_2$ and $102_3$ of the angle setting means 102 and ends at a point proximate side $102_4$ and midpoint M. The desired angle is determined by placing a first screw 103*a* through aperture 102*a* and screwing it into receptacle $18r_1$, located at a point intermediate the ends of side frame member 18 and placing a second screw 103*b* through either aperture 102*b* (for a 75° setting), 102*c* (for a 63° setting), or 102*d* (for a 45° setting) and screwing it into receptacle 18*r*$_2$, which is proximate receptacle 18*r*$_1$. The second support means 90 is attached to side frame member 20 in a similar manner. A mounting tab 104 is mounted perpendicular to the angle iron of the leg 92 proximate a second end 92*b*. An aperture (not numbered) is formed at the center of the tab 104 for a first mounting screw 106 to pass through and secure the leg 92 to the spring 94.

Spring 94 comprises a helical wound coil 108 having an end cap 110 at each end. An aperture (not numbered) is formed in the center of each end cap 110 and threaded to accept the first mounting screw 106 and a second mounting screw 112 at their respective ends.

In the preferred embodiment, the cross-member 96 and post means 98 are manufactured out of an angle iron material, such as aluminum. The exact material selected is not critical so long as it has sufficient strength to resist twisting in a high wind situation. An aperture 116 is provided at a point intermediate end points 96*a*,96*b* of the cross-member 96 for the second mounting screw 112 to pass through. A first and second end hole 118,120 is formed in the cross-member 96 proximate each end point 96*a*,96*b*. The end holes 118,120 are perpendicular to aperture 116 and receive a screw 122,124 which passes therethrough and secures the cross-member 96 to the post means 98.

When the sun protection assembly is mounted on a roof, the post means 98 are embedded in weighted means 114, such as concrete blocks. An opening 130 is created through a side of the post means 98 proximate its free end to receive screw 122 or 124, to be discussed below. Each block 114, which weighs approximately 40 pounds, is fabricated in a similar manner as described in embodiment three above. If the assembly 88 is secured to the ground, the anchoring means 98 can be driven into the ground as in the first embodiment.

The frame 18 of the sun shade assembly 88 is assembled as in the previous embodiments. Screw 106 is inserted through the threaded aperture of the mounting tab 104 and screwed into the aperture of one of the end caps 110 of the spring 94. Screw 112 is placed through aperture 116 of the cross-member 96 and screwed into the threaded aperture of the second end cap 110 of the spring 94. The cross-member 96 is then attached to the anchoring means 98 which have been positioned at the desired location. Screws 122,124 pass through their respective end holes 118,120 in the cross-member 96 and opening 130 of each post means 98 and engage nuts 126,128.

Figure 11:
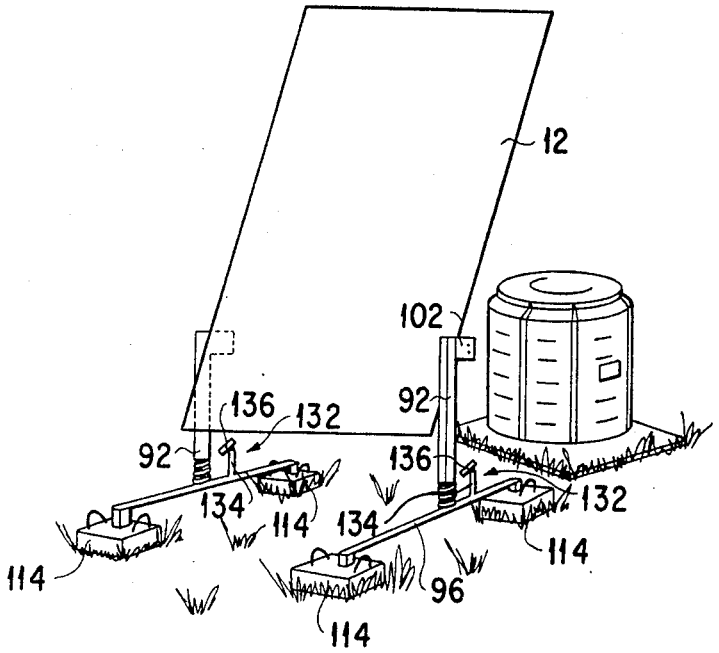

If desired, a brake 132 may be placed on the cross-member 96 as shown in FIG. 11. The brake 132 reduces the risk of damage by preventing the sun protection assembly 88 from hitting the air conditioner/heat pump unit as the wind pushes the assembly 88. Brake 132 comprises a stop post 134 which is mounted on each cross-member 96 a predetermined distance behind the legs 92. The stop posts are manufactured out of the same material used to make the legs 92. The stop posts 134 are attached to the cross members 96 by any suitable means, such as with screws. A stopper 136 is positioned proximate the free end of the stop post 134. The stopper 136 contacts the leg 92 of the sun protection assembly 88 in high wind conditions.

While the invention has been particularly shown and described with reference to the perferred embodiments thereof, it will be understood by those skilled in the art that various alterations in form and detail may be made without departing from the spirit and scope of the invention. For example, if the frame 12 is very large, a supporting member may be installed longitudinally about the middle of the frame to offer additional support.

The embodiments of the invention in which an exclusive property or privilege are claimed are defined as follows:

1. A sun protection assembly for shielding a cooling unit from the direct rays of the sun, comprising:

(a) a frame;

(b) a screen attached to said frame, said screen permitting air to flow therethrough; and (c) supporting means attached to said frame for supporting said assembly a predetermined distance above said cooling unit in a manner whereby said screen shields said unit from direct rays of the sun without interfering with the free flow of air above and around said cooling unit, said supporting means comprising a front leg and a rear leg, said rear leg being longer than said front leg.

2. A sun protection assembly as recited in claim 1 wherein at least one of said front and rear legs includes a ground stake for anchoring said legs into the ground.

3. A sun protection assembly as recited in claim 1 wherein at least one of said front and rear legs includes a foot pad for anchoring said legs onto a hard surface.

4. A sun protection assembly as recited in claim 1 wherein at least one of said front and rear legs includes a weighted means to prevent said assembly from moving.

5. A sun protection assembly for shielding a cooling unit from the direct rays of the sun comprising:

(a) a subtantially rectangular frame, said frame having two end frame members and two side frame members;

(b) a screen secured to said frame and extending between said two end frame members and said two side frame members;

(c) supporting means attached to said frame to support said assembly a predetermined distance above the ground; and, (d) anchoring means attached to said supporting means to anchor said assembly to the ground.

6. A sun protection assembly as recited in claim 5 wherein said supporting means comprises a leg perpendicularly attached to a cross-member at a point intermediate the length of said cross-member, each end of said cross-member being secured to said anchoring means.

7. A sun protection assembly as recited in claim 6 wherein a spring is interposed between said leg and said cross-member, said spring permitting said sun protection assembly to sway in a high wind condition.

8. A sun protection assembly as recited in claim 6 wherein an angle setting means is secured to the end of said leg that is attached to said frame, said angle setting means permitting said frame to be positioned at an optimum shading angle based upon the geographic location and compass direction of the installation relative to the sun.

9. A sun protection assembly as recited in claim 8 wherein said angle setting means permits said frame to be oriented at an angle of approximately 45 degrees, 63 degrees or 75 degrees relative to the ground.

10. A sun protection assembly as recited in claim 5 wherein said side frame members have a groove along their inner surface extending from one edge of said side frame member to the other edge, and said end frame members have a groove along their top surface extending from one edge of said end frame member to the other edge.

11. A sun protection assembly as recited in claim 10 wherein said screen is secured to said frame by forcing an edge of said screen into said groove.

12. A sun protection assembly as recited in claim 5 wherein said anchoring means comprises a ground stake for anchoring said assembly into the ground.

13. A sun protection assembly as recited in claim 5 wherein said anchoring means comprises a foot pad to anchor said assembly to a hard surface.

14. A sun protection assembly as recited in claim 5 wherein said anchoring means comprises a weighted concrete block for anchoring said assembly to a surface.

15. A sun protection assembly for shielding a cooling unit from the direct rays of the sun, comprising:

(a) a subtantially rectangular frame, said frame comprising:

(i) two side frame members, each of said side frame members having two sides, a top, a bottom, and two edges, said sides which face the inside portion of said frame having a groove running from one edge of said side frame member to the other edge thereof; and, (ii) two end frame members, each of said end frame members having two sides, a top, a bottom, and two edges, said top having a groove running from one edge of said end frame member to the other edge thereof, (b) a screen constructed of a material which allows air to pass therethrough, said screen being secured in said grooves of said frame members; and, (c) a front leg and a rear leg, each leg being attached to said side frame member proximate an edge of said side frame member, said front leg being shorter than said rear leg for securing said assembly a predetermined distance above the ground at a desired angle relative to the ground.

16. A sun protection assembly as recited in claim 15 wherein a spline retains said screen in said grooves.

17. A sun protection assembly as recited in claim 15 wherein said legs include a ground stake for anchoring said assembly into the ground.

18. A sun protection assembly as recited in claim 15 wherein said legs include a foot pad for anchoring said assembly to a hard surface.

19. A sun protection assembly as recited in claim 15 wherein said legs include a weighted means for anchoring said assembly to a surface.

20. A kit for assembling a sun protection assembly to shield a cooling unit from the direct rays of the sun, said kit comprising:

(a) two side frame members and two end frame members;

(b) an air permeable screen, said screen having a left edge, a right edge, a front edge, and a rear edge;

(c) means for connecting said frame members together to form a substantially rectangular frame;

(d) means for securing said screen to said frame members;

(e) supporting means to support said frame a predetermined distance above the ground; and, (f) means for attaching said supporting means to said frame.

21. The kit of claim 20 including a ground stake attached to the bottom end of said supporting means to permit anchoring said assembly in the ground.

22. The kit of claim 20 including a foot pad attached to the bottom end of said supporting means to permit anchoring said assembly to a hard surface.

23. The kit of claim 20 including a weighted means attached to the bottom end of said supporting means to prevent said kit from moving.

24. A method of assembling a sun protection assembly for preventing a cooling unit from being heated by the sun's rays, the method comprising the steps of:

(a) separating two side frame members a predetermined distance as defined by the width of an air permeable screen;

(b) at least partially inserting corner brackets into each end of the two side frame members;

(c) inserting each end of two end frame members into at least a portion of a corner bracket so as to create a substantially rectangular frame;

(d) securing the front and rear edges of the screen to the two end frame members; and, (e) attaching a supporting means to the side frame members of the frame so as to support the screen a predetermined distance above the ground.

25. The method of claim 24 including the step of attaching a ground stake to the bottom end of each leg to permit the anchoring of the assembly in the ground.

26. The method of claim 24 including the step of attaching a foot pad to the bottom end of each leg to permit the anchoring of the assembly to a hard surface.

27. The method of claim 24 including the step of attaching a weighted means to the bottom end of each leg.

28. The method of claim 24 wherein the supporting means comprises a pair of front legs and a pair of rear legs, the rear legs being longer than the front legs.

* * * * *